US008505721B2

(12) United States Patent
Schütz

(10) Patent No.: US 8,505,721 B2
(45) Date of Patent: Aug. 13, 2013

(54) SUPPORT BASE FOR TRANSPORT AND STORAGE CONTAINERS FOR LIQUIDS

(75) Inventor: Udo Schütz, Selters (DE)

(73) Assignee: Protechna S.A., Fribourg (CH)

( * ) Notice: Subject to any disclaimer, the term of this patent is extended or adjusted under 35 U.S.C. 154(b) by 0 days.

(21) Appl. No.: 13/457,817

(22) Filed: Apr. 27, 2012

(65) Prior Publication Data

US 2012/0211395 A1 Aug. 23, 2012

Related U.S. Application Data

(63) Continuation of application No. 10/977,616, filed on Oct. 27, 2004, now abandoned.

(30) Foreign Application Priority Data

Oct. 31, 2003 (DE) ..... 203 16 883

(51) Int. Cl.
*B65D 19/00* (2006.01)

(52) U.S. Cl.
USPC ..... 206/386; 220/9.4; 220/23.91

(58) Field of Classification Search
USPC ..... 206/386; 220/9.1–9.4, 23.91
See application file for complete search history.

(56) References Cited

U.S. PATENT DOCUMENTS

| | | | | |
|---|---|---|---|---|
| 2,849,765 | A | 9/1958 | DeSena | |
| 3,624,340 | A | 11/1971 | Hinden | |
| 4,157,609 | A | 6/1979 | Schutz | |
| 4,359,813 | A | 11/1982 | Mauer | |
| 4,676,373 | A * | 6/1987 | Schneider | 220/9.4 |
| 4,909,387 | A | 3/1990 | Schutz | |
| 4,947,988 | A | 8/1990 | Schutz | |
| 5,024,346 | A * | 6/1991 | Roser | 220/9.1 |
| 5,058,747 | A * | 10/1991 | Decroix et al. | 220/9.1 |
| 5,918,744 | A | 7/1999 | Bringard et al. | |
| 5,947,630 | A | 9/1999 | Dillon | |
| 6,029,839 | A | 2/2000 | Mansouri | |
| 6,202,844 | B1 | 3/2001 | Sedlmayr | |
| 6,622,642 | B2 * | 9/2003 | Ohanesian | 108/57.25 |
| 2002/0104465 | A1 | 8/2002 | Ohanesian | |

FOREIGN PATENT DOCUMENTS

DE 10062088 C2 10/2002

* cited by examiner

*Primary Examiner* — Bryon Gehman

(74) *Attorney, Agent, or Firm* — Lucas & Mercanti, LLP; Klaus P. Stoffel

(57) ABSTRACT

A support base for transport and storage containers for liquids includes an inner container of plastics material and an outer jacket of a metal grid or of sheet metal which is adapted to be manipulated by a forklift, a shelf operating system or a similar transport medium, and with a bottom of metal resting on support legs of metal, a middle runner and two outer runners for supporting the inner container which is equipped with a closable filler connection and a drain connection for connection to a drain fitting. The middle runner and the two outer runners of the support base are constructed as wooden runners.

8 Claims, 3 Drawing Sheets

SUPPORT BASE FOR TRANSPORT AND STORAGE CONTAINERS FOR LIQUIDS

CROSS-REFERENCE TO RELATED APPLICATIONS

The present application is a Continuation Application of U.S. patent application Ser. No. 10/977,616, filed Oct. 27, 2004, which claims priority of DE 203 16 883.6, filed Oct. 31, 2003, the priority of these applications is hereby claimed and these applications are incorporated herein by reference.

BACKGROUND OF THE INVENTION

1. Field of the Invention

The present invention relates to a pallet-like support base for transport and storage containers for liquids with an inner container of plastics material and an outer jacket of a metal grid or of sheet metal which is adapted to be manipulated by a forklift, a shelf operating system or a similar transport medium, and with a bottom of metal resting on support legs of metal, a middle runner and two outer runners for supporting the inner container which is equipped with a closable filler connection and a drain connection for connection to a drain fitting.

2. Description of the Related Art

When transporting known support bases of this type, known from DE 100 62 088 C2, together with the filled liquid containers placed on these support bases on a roller conveyor, the use of metal runners is the reason that the container does not have the required resistance to sliding which is required for a safe transport.

Another disadvantage of support bases equipped with metal runners of the known transport and storage containers for liquids is the fact that, when the containers are transported on roller conveyors, the friction between the transport rollers of metal and the metal runners of the support bases may cause electrical spark discharges to occur which lead to the danger that flammable substances filled into the transport and storage containers and explosive mixtures of gases and vapors in closed spaces may ignite.

SUMMARY OF THE INVENTION

It is the primary object of the present invention to improve the transport safety of the support base of the above-described type for transport and storage containers for liquids on conveying systems, such as roller conveyors.

In accordance with the present invention, the middle runner and the two outer runners of the support base are constructed as wooden runners.

By equipping the pallet-like support base for liquid containers according to the present invention with wooden runners, which compared to metal runners of known liquid containers have a significantly higher friction coefficient, the anti-skid effect of the liquid containers equipped with the support base on roller conveyors is improved and the danger of a spark discharge due to friction electricity during the transport of the containers on roller conveyors is avoided. Moreover, due to the wooden runners of the support base of the liquid container, the wear of the roller conveyors is significantly less than in the case of liquid containers with metal runners. Finally, if the liquid container equipped with the support base with runners is used as a reusable container, damaged wooden runners can be exchanged and the wooden material can be recycled or burned for producing thermal energy.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
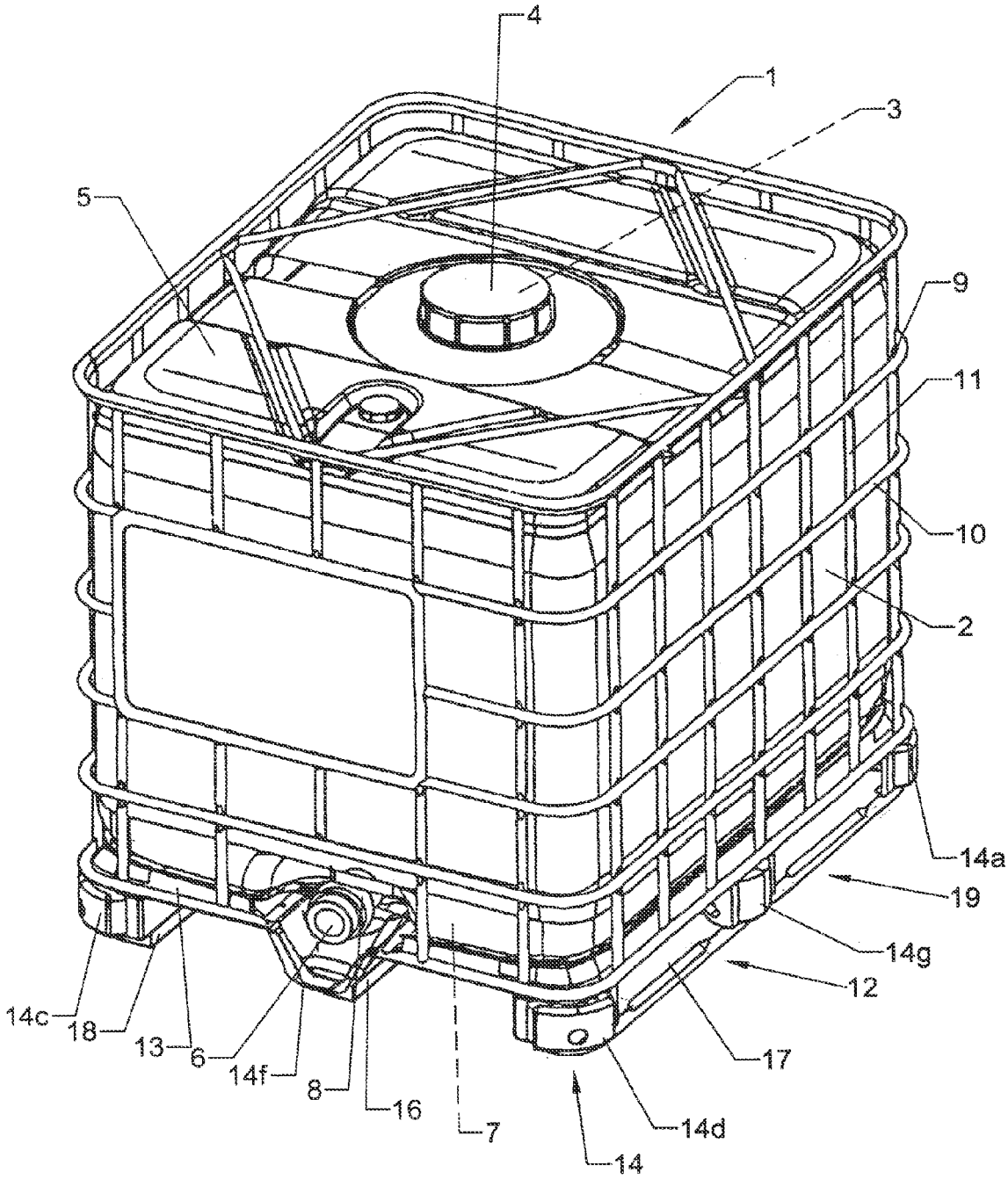
FIG. 1 is a perspective view of a transport and storage container for liquids with a pallet-like support base.
Figure 2:
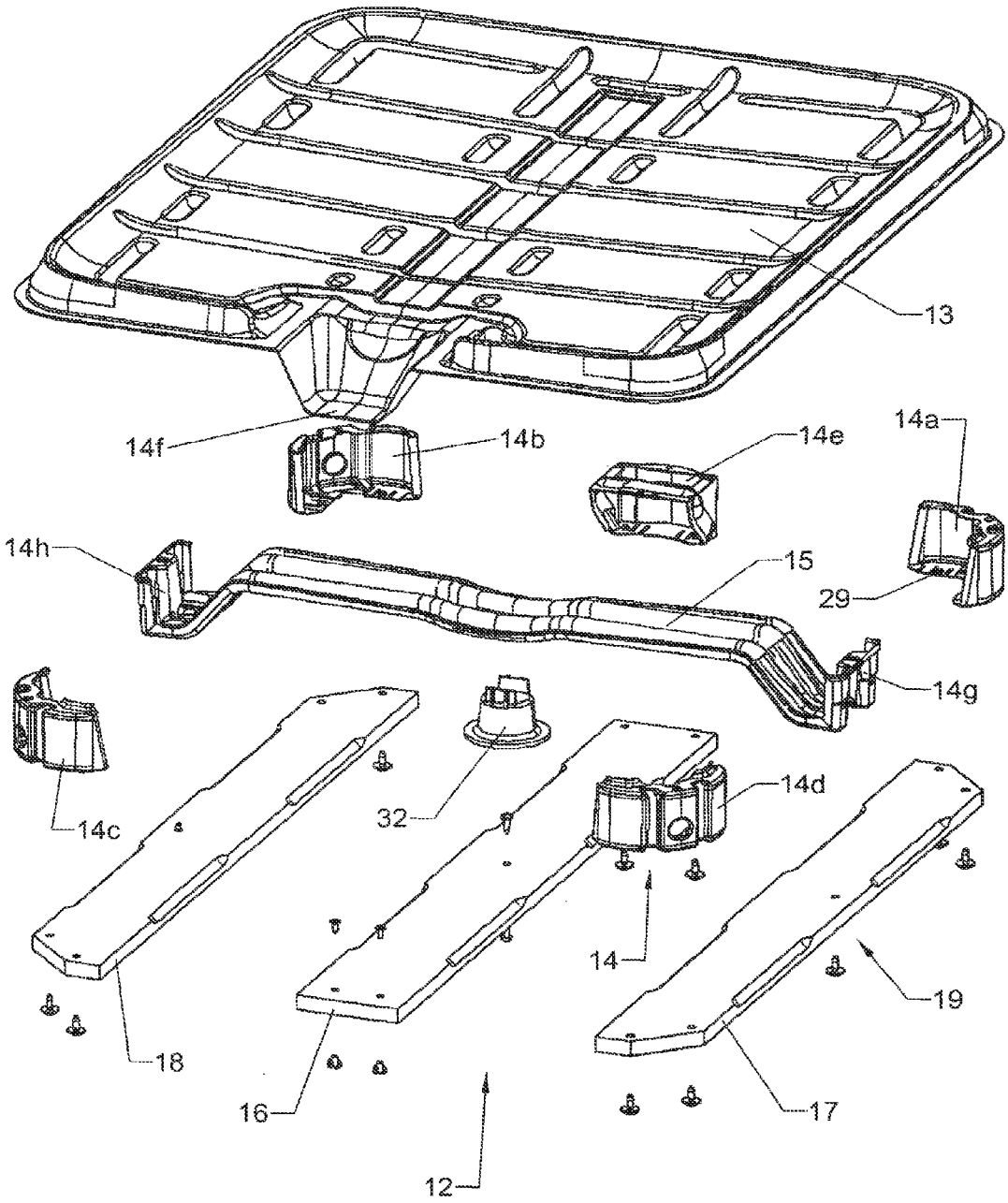
FIG. 2 is an exploded view of the support base.

The transport and storage container 1 for liquids which is used as a single-use or a reusable container has as its primary components a replaceable right parallelepiped-shaped inner container 2 of plastics material which is equipped with a filler connection 3 in the upper top 5 which is closable with a cap 4 and a drain connection 6 in the area of the lower bottom 7 for connecting a drain and flushing valve 8, an outer jacket 9 of intersecting horizontal and vertical grating bars 10, 11 of metal, and a pallet-like support base 12 with length and width dimensions which conform to European standards, wherein a bottom 13 of sheet metal constructed as a flat bottom tub supports the inner container 2 of plastics material.

The tub-like bottom 13 of the support base 12 adapted for manipulation by a forklift, a shelf operating system and the like transport systems, rests on support legs 14 of sheet metal which include the four corner legs 14*a* to 14*d*, a rear middle leg 14*e*, a front middle leg 14*f*, which is formed in the bottom 13 and is arranged underneath the drain/flushing valve 8 of the transport container 1, and two lateral middle legs 14*g*, 14*h* which are formed by the outer ends of a bridge-like stiffening sheet metal 15 for the bottom 13.

The support legs 14 of the support base 2 are mounted on a middle runner 16 and two outer runners 27, 28 which are constructed as wooden runners 19 and are made of flat boards.

FIGS. 3*a* to 3*d* show four different types of connections of the wooden runners 19 to the support legs 14 of sheet metal for the bottom 13 of the support base 12.

Figure 3A:
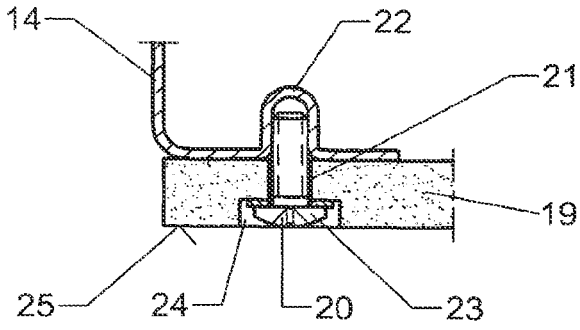
FIGS. 3*a* to 3*d* are schematic illustrations, on a larger scale, showing different types of connections of the wooden runners to the support legs of metal of the support base.

As shown in FIG. 3*a*, the wooden runners 19 are screwed to the support legs 14 by means of self-cutting sheet metal screws 20 which are inserted through bores 21 in the wooden runners 19 and are screwed into tulip-like recesses 22 of the support legs 14, wherein the screw heads 23 are received in recesses 24 in the bottom side 25 of the wooden runner 19.

Figure 3B:
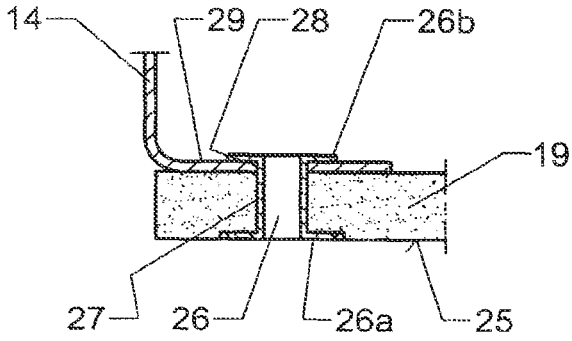

FIG. 3*b* shows a connection of the wooden runners 19 to the support legs 14 by means of hollow rivets 26 which are inserted into bores 27, 28 having the same size in the wooden runners 19 and into the supporting side 29 of the support leg 14, wherein the ends 26*a*, 26*b* of the rivets 26 are bent against the bottom side 25 of a wooden runner 19 and against the supporting side 29 of a support leg 14.

Figure 3C:
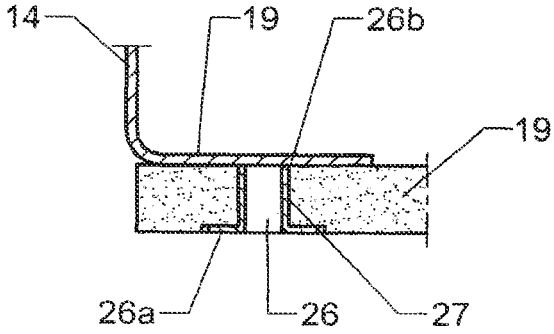

In the connection of the wooden runners 19 to the support legs 14 by means of hollow rivets 26 shown in FIG. 3*c*, the hollow rivets are inserted through bores 27 in the wooden runners 19. Subsequently, one end 26*b* of the hollow rivet 26 is welded to the supporting side 29 of a support leg 14 and the other end 26*a* of the hollow rivet 26 is then bent toward a wooden runner 19. Welding of the hollow rivet 26 to the support leg 14 can be effected by friction welding, laser welding or resistance welding.

Figure 3D:
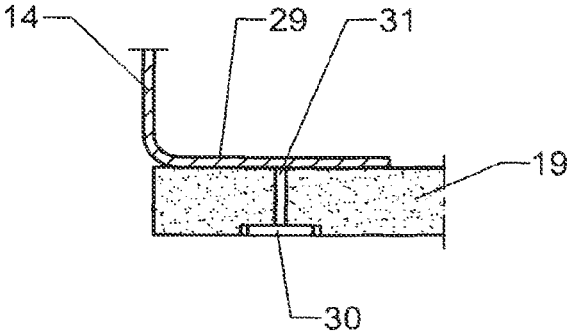

The connection illustrated in FIG. 3*d* utilizes nails 30 which are driven into the wooden runners 19 and whose nail tips 31 which make contact with the supporting side 29 of the support leg 14 are welded to the supporting side of the support leg.

In addition to the support legs 14, the bottom 13 of the support base 12 of the transport container 1 is supported in the border area thereof by an additional metal support 32 in the central area, wherein the middle support 32 is composed of wood, plastics material or metal and is screwed to the bottom 13 and the middle runner 16 of the support base 12.

The metal support 32 prevents bending of the bridge-like stiffening sheet metal 15 of the bottom 13 of the support base 12 which would occur under the influence of the weight force of a container filling as a result of the reduced stability of the support base caused by the wood runner support base construction as compared to a support base which consists entirely of metal components, so that the bottom clearance of the bridge-like stiffening sheet metal of the support base bottom, which is required for ensuring that the gripping arms of a transport device can unimpededly move underneath the support base, is ensured.

While specific embodiments of the invention have been shown and described in detail to illustrate the inventive principles, it will be understood that the invention may be embodied otherwise without departing from such principles.

I claim:

1. A support base for transport and storage containers for liquids comprising an inner container of plastics material and an outer jacket of a metal grating or of sheet metal, wherein the support base is adapted to be manipulated by forklifts and shelf operating systems, the support base comprising a bottom of sheet metal resting on support legs of metal, each support leg being mounted to one of a middle runner and two outer runners, wherein the inner container is equipped with a closable filler connection and a drain connection for connection to a drain fitting, wherein the middle runner and the two outer runners are wooden runners made of flat boards.

2. The support base according to claim 1, comprising a connection of the wooden runners to the support legs by self-cutting sheet metal screws, wherein the sheet metal screws extend through bores in the wooden runners and are screwed into recesses of the support legs.

3. The support base according to claim 1, comprising a connection of the wooden runners of the support legs by rivets extending through bores in the wooden runners and in the support legs having the same size, wherein the heads of the rivets are bent toward a wooden runner and toward a support leg, respectively.

4. The support base according to claim 1, comprising a connection of the wooden runners to the support legs by hollow rivets extending through bores in the wooden runners, wherein a first end of each hollow rivet is welded to a support leg and a second end of the hollow rivet is bent toward a wooden runner.

5. The support base according to claim 1, comprising a connection of the wooden runners of the support legs by nails driven into the wooden runners, wherein tips of the nails which are in contact with the support legs are welded to the support legs.

6. The support base according to claim 1, further comprising a middle support member for supporting the bottom on the middle runner, wherein the middle support member is screwed to the bottom and the middle runner and wherein the middle support member is of wood, plastics material or metal.

7. The support base according to claim 6, wherein the middle support member is screwed to the bottom and the middle runner.

8. The support base according to claim 6, wherein the middle support member is of wood, plastics material or metal.

* * * * *